US009850768B2

(12) United States Patent
Taima

(10) Patent No.: US 9,850,768 B2
(45) Date of Patent: Dec. 26, 2017

(54) TURBINE WHEEL INCLUDING A TURBINE DISK, TURBINE BLADES, AND SEAL PLATES

(71) Applicant: HONDA MOTOR CO., LTD., Tokyo (JP)

(72) Inventor: Koji Taima, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 215 days.

(21) Appl. No.: 14/645,801

(22) Filed: Mar. 12, 2015

(65) Prior Publication Data

US 2015/0260050 A1 Sep. 17, 2015

(30) Foreign Application Priority Data

Mar. 14, 2014 (JP) ..... 2014-51865

(51) Int. Cl.
*F01D 5/30* (2006.01)
*F01D 11/00* (2006.01)

(52) U.S. Cl.
CPC ..... *F01D 5/3015* (2013.01); *F01D 11/006* (2013.01); *F05D 2220/32* (2013.01)

(58) Field of Classification Search
CPC ..... F01D 5/32; F01D 5/326; F01D 5/3015; F01D 11/006; F05D 2220/30; F05D 2220/32
See application file for complete search history.

(56) References Cited

U.S. PATENT DOCUMENTS 2,755,063 A * 7/1956 Wilkinson ..... F01D 5/3015 192/105 BA
7,264,447 B2 * 9/2007 Ono ..... F01D 11/005 416/193 A
2008/0196247 A1 * 8/2008 Ravi ..... F01D 5/3015 29/889.2
2009/0092497 A1 * 4/2009 Boeck ..... F01D 5/3015 416/220 R
2010/0047073 A1 * 2/2010 Bluck ..... F01D 5/3015 416/220 R
2013/0294927 A1 * 11/2013 Dimmick, III ..... F01D 11/006 416/96 R
2014/0356175 A1 * 12/2014 Haydn-Smith ..... F01D 5/323 416/204 R

FOREIGN PATENT DOCUMENTS

JP 2005-163732 6/2005

* cited by examiner

*Primary Examiner* — Nathaniel Wiehe
*Assistant Examiner* — Elton Wong
(74) *Attorney, Agent, or Firm* — Rankin, Hill & Clark LLP

(57) ABSTRACT

In a turbine wheel, each of seal plates is formed from an elastic plate member whose radially intermediate portion is curved projecting toward one axial end surfaces of turbine blades and a turbine disk. The seal plate includes: an assembly recessed portion recessed in a direction getting closer to the one axial end surfaces, near a radially outer end of the plate; and a disassembly protrusion projecting in a direction getting away from the one axial end surfaces, near a radially inner end of the plate. When the recessed portion is pressed for attaching the plate, a tip end of the recessed portion comes into contact with the one axial end surface of each turbine blade or the disk. The plate is accordingly inhibited from being excessively deformed. Thus, the plate is blocked from being plastically deformed, and is precluded from coming off the wheel.

13 Claims, 5 Drawing Sheets

TURBINE WHEEL INCLUDING A TURBINE DISK, TURBINE BLADES, AND SEAL PLATES

CROSS REFERENCE TO RELATED APPLICATIONS

The present application claims priority under 35 U.S.C. §119 to Japanese Patent Application No. 2014-51865 filed Mar. 14, 2014 the entire contents of which are hereby incorporated by reference.

BACKGROUND OF THE INVENTION

Field of the Invention

The present invention relates to a turbine wheel comprising a turbine disk including a plurality of groove portions which are formed in its outer periphery; a plurality of turbine blades respectively including protrusions which are formed on their base ends, and fixed to the turbine disk by fitting the protrusions into the groove portions in an axial direction; and seal plates for sealing gaps between the groove portions and the protrusions by being fixed to respective one axial end surfaces of the turbine blades and the turbine disk.

Description of the Related Art

One such turbine wheel has been publicly known in Japanese Patent Application Laid-open No. 2005-163732. The seal plates of this turbine wheel are designed as follows. Each seal plate is formed from a curved elastic plate member that is fixed with a radially outer end portion of the elastic plate member in engagement with an outer annular groove which is formed in the one axial end surface of the turbine blade and opened inward in a radial direction, and with a radially inner end portion of the elastic plate member in engagement with an inner annular groove which is formed in the one axial end surface of the turbine disk and opened outward in the radial direction. Attachment of the seal plate is achieved by: elastically deforming the seal plate by pressing protrusions formed on the elastic plate member in a way that the seal plate comes into intimate contact with the one axial end surface of the turbine blade or the one axial end surface of the turbine disk; and with the seal plate thus kept elastically deformed, bringing the radially outer end portion of the seal plate into engagement with the outer annular groove of the turbine blade by moving the seal plate outward in the radial direction.

The above-mentioned conventional turbine wheel, however, involves the likelihood that: when the protrusions are pressed for the purpose of attaching the seal plate to the turbine blades and the turbine disk, the seal plate formed from the elastic plate member is excessively deformed and thus plastically deformed; and the seal plate resultantly loses its elasticity, and comes out of the outer annular grooves and the inner annular groove.

SUMMARY OF THE INVENTION

The present invention has been made with the foregoing situation taken into consideration. An object of the present invention is to preclude the seal plate from coming off the turbine wheel by inhibiting the seal plate from being excessively deformed while the seal plate is being attached.

In order to achieve the object, according to a first feature of the present invention, there is provided a turbine wheel comprising: a turbine disk including a plurality of groove portions which are formed in its outer periphery; a plurality of turbine blades respectively including protrusions which are formed on their base ends, and fixed to the turbine disk by fitting the protrusions into the groove portions in an axial direction; outer annular grooves each formed in one axial end surface of the corresponding turbine blade, and each opened inward in a radial direction; an inner annular groove formed in one axial end surface of the turbine disk, and opened outward in the radial direction; and seal plates for sealing gaps between the groove portions and the protrusions by being fixed to the respective one axial end surfaces of the turbine blades and the turbine disk with a radially outer end portion of each of the seal plates in contact with a groove bottom of the corresponding outer annular groove, and with a radially inner end portion of each seal plate in engagement with a step portion in the inner annular groove, wherein each seal plate is formed from an elastic plate member whose radially intermediate portion is curved projecting toward the one axial end surfaces, and the seal plate includes an assembly recessed portion, which is recessed in a direction getting closer to the one axial end surfaces, in a position near a radially outer end of the seal plate, and a disassembly protrusion, which projects in a direction getting away from the one axial end surfaces, in a position near a radially inner end of the seal plate.

According to the first feature of the present invention, the turbine wheel including: the turbine disk including the multiple groove portions which are formed in its outer periphery; the multiple turbine blades respectively including the protrusions which are formed on their base ends, and fixed to the turbine disk by fitting the protrusions into the groove portions in the axial direction; the outer annular grooves each formed in the one axial end surface of the corresponding turbine blade, and each opened inward in the radial direction; the inner annular groove formed in the one axial end surface of the turbine disk, and opened outward in the radial direction; and the seal plates for sealing the gaps between the groove portions and the protrusions by being fixed to the respective one axial end surfaces of the turbine blades and the turbine disk with the radially outer end portion of each of the seal plates in contact with the groove bottom of the corresponding outer annular groove, and with the radially inner end portion of each seal plate in engagement with the step portion in the inner annular groove.

Each seal plate is formed from the elastic plate member whose radially intermediate portion is curved projecting toward the one axial end surfaces. The seal plate includes: the assembly recessed portion, which is recessed in the direction getting closer to the one axial end surfaces, in the position near the radially outer end of the seal plate; and the disassembly protrusion, which projects in the direction getting away from the one axial end surfaces, in the position near the radially inner end of the seal plate. For these reasons, the seal plate can be attached to the turbine wheel by: putting the radially outer end portion of the seal plate opposite the outer annular groove by pressing the assembly recessed portion with the radially inner end portion of the seal plate in contact with the groove bottom of the inner annular groove; and bringing the radially outer end portion of the seal plate into contact with the groove bottom of the outer annular groove, and concurrently bringing the radially inner end portion of the seal plate into engagement with the step portion in the inner annular groove, by moving the seal plate outward in the radial direction. In addition, the seal plate can be detached from the turbine wheel by: releasing the radially inner end portion of the seal plate from its engagement with the step portion by pressing the disassembly protrusion of the attached seal plate; bringing the radially inner end portion of the seal plate into contact with the groove bottom of the inner annular groove by moving the seal plate inward in the radial direction; and thereby making the radially outer end portion of the seal plate come out of the outer annular groove.

When the assembly recessed portion is pressed for the purpose of attaching the seal plate, a tip end of the assembly recessed portion comes into contact with the one axial end surface of each turbine blade or the turbine disk, and the seal plate is accordingly inhibited from being excessively deformed. For this reason, the seal plate formed from the elastic plate member is blocked from being plastically deformed, and is precluded from coming off the turbine wheel.

According to a second feature of the present invention, in addition to the first feature, the assembly recessed portion is formed from a groove extending in a peripheral direction of the seal plate, and a section of the assembly recessed portion is arcuate.

According to the second feature of the present invention, the assembly recessed portion is formed from the groove extending in the peripheral direction of the seal plate, and the section of the assembly recessed portion is arcuate. The section not only makes it easier to control a thickness of the assembly recessed portion and secures strength of the assembly recessed portion more reliably, while the seal plate is being manufactured. But also, the section makes stress less likely to concentrate on the assembly recessed portion when the assembly recessed portion is pressed for the purpose of fitting the seal plate into the outer annular grooves of the turbine blades, and makes the tip end of the assembly recessed portion come into contact with the one axial end surface of each turbine blade or the turbine disk with a wider area. This makes it possible to prevent the plastic deformation of the seal plate more securely.

The above and other objects, characteristics and advantages of the present invention will be clear from detailed descriptions of the preferred embodiment which will be provided below while referring to the attached drawings.

DESCRIPTION OF THE PREFERRED EMBODIMENT

Descriptions will be hereinbelow provided for an embodiment of the present invention on the basis of FIGS. 1 to 5C.

Figure 1:
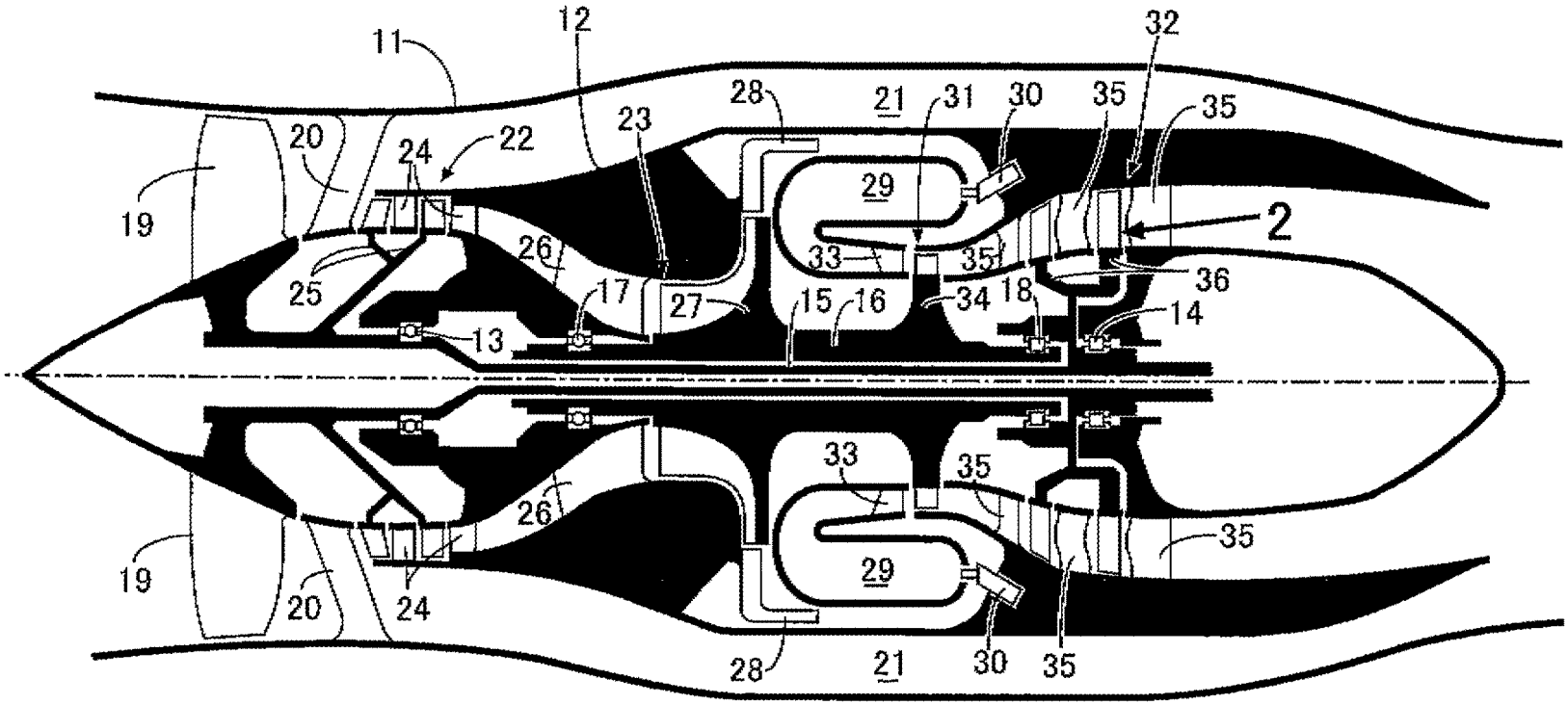
FIG. 1 is a view showing an overall structure of a twin-spool turbofan engine.

As shown in FIG. 1, a twin-spool turbofan engine for an aircraft to which the present invention is applied includes an outer casing 11 and an inner casing 12. Front and rear portions of a low-pressure system shaft 15 are rotatably supported by an inside of the inner casing 12 via front and rear first bearings 13, 14, respectively. A tubular high-pressure system shaft 16 is fitted to an outer periphery of an axial-direction intermediate portion of the low-pressure system shaft 15 in a relatively rotatable manner. A front portion of the high-pressure system shaft 16 is rotatably supported by the inner casing 12 via a front second bearing 17, while a rear portion of the high-pressure system shaft 16 is supported by the low-pressure system shaft 15 in a relatively rotatable manner via a rear second bearing 18.

A front fan 19 having blade ends which face an inner surface of the outer casing 11 is fixed to a front end of the low-pressure system shaft 15. Part of air sucked by the front fan 19 passes through stator vanes 20 disposed between the outer casing 11 and the inner casing 12. Part of the air having passed through the stator vanes 20 thereafter passes through an annular bypass duct 21 formed between the outer casing 11 and the inner casing 12, and is jetted rearward. Other part of the air is supplied to an axial low-pressure compressor 22 and a centrifugal high-pressure compressor 23 which are disposed inside the inner casing 12.

The low-pressure compressor 22 includes: stator vanes 24 fixed to the inside of the inner casing 12; and a low-pressure compressor wheel 25 having compressor blades on its outer periphery, and fixed to the low-pressure system shaft 15. The high-pressure compressor 23 includes stator vanes 26 fixed to the inside of the inner casing 12; and a high-pressure compressor wheel 27 having compressor blades on its outer periphery, and fixed to the high-pressure system shaft 16.

A reverse-flow combustion chamber 29 is disposed in a rear of a diffuser 28 connected to an outer periphery of the high-pressure compressor wheel 27. Fuel injection nozzles 30 inject fuel into the reverse-flow combustion chamber 29. The fuel and the air are mixed together and combusted inside the reverse-flow combustion chamber 29. The generated combustion gas is supplied to a high-pressure turbine 31 and a low-pressure turbine 32.

The high-pressure turbine 31 includes: nozzle guide vanes 33 fixed to the inside of the inner casing 12; and a high-pressure turbine wheel 34 having turbine blades on its outer periphery, and fixed to the high-pressure system shaft 16. The low-pressure turbine 32 includes: nozzle guide vanes 35 fixed to the inside of the inner casing 12; and low-pressure turbine wheels 36 each having turbine blades on its outer periphery, and fixed to the low-pressure system shaft 15.

For this reason, once the high-pressure system shaft 16 is driven by a starter motor (not illustrated), air sucked by the high-pressure compressor wheel 27 is supplied to the reverse-flow combustion chamber 29, and mixed with the fuel to be combusted. The generated combustion gas drives the high-pressure turbine wheel 34 and the low-pressure turbine wheels 36. As a result, the low-pressure system shaft 15 and the high-pressure system shaft 16 rotate. Accordingly, the front fan 19, the low-pressure compressor wheel 25 and the high-pressure compressor wheel 27 compress air, and supply the compressed air to the reverse-flow combustion chamber 29. Thereby, even after operation of the starter motor is stopped, the turbofan engine continues its operation.

While the turbofan engine is in operation, part of air sucked by the front fan 19 passes through the bypass duct 21, and is jetted rearward so as to, particularly during low-speed flight, generate main thrust. The remaining part of the air sacked by the front fan 19 is supplied to the reverse-flow combustion chamber 29, and is mixed with the fuel to be combusted. The combusted gas drives the low-pressure system shaft 15 and the high-pressure system shaft 16, and is thereafter jetted rearward, generating thrust.

Figure 2:
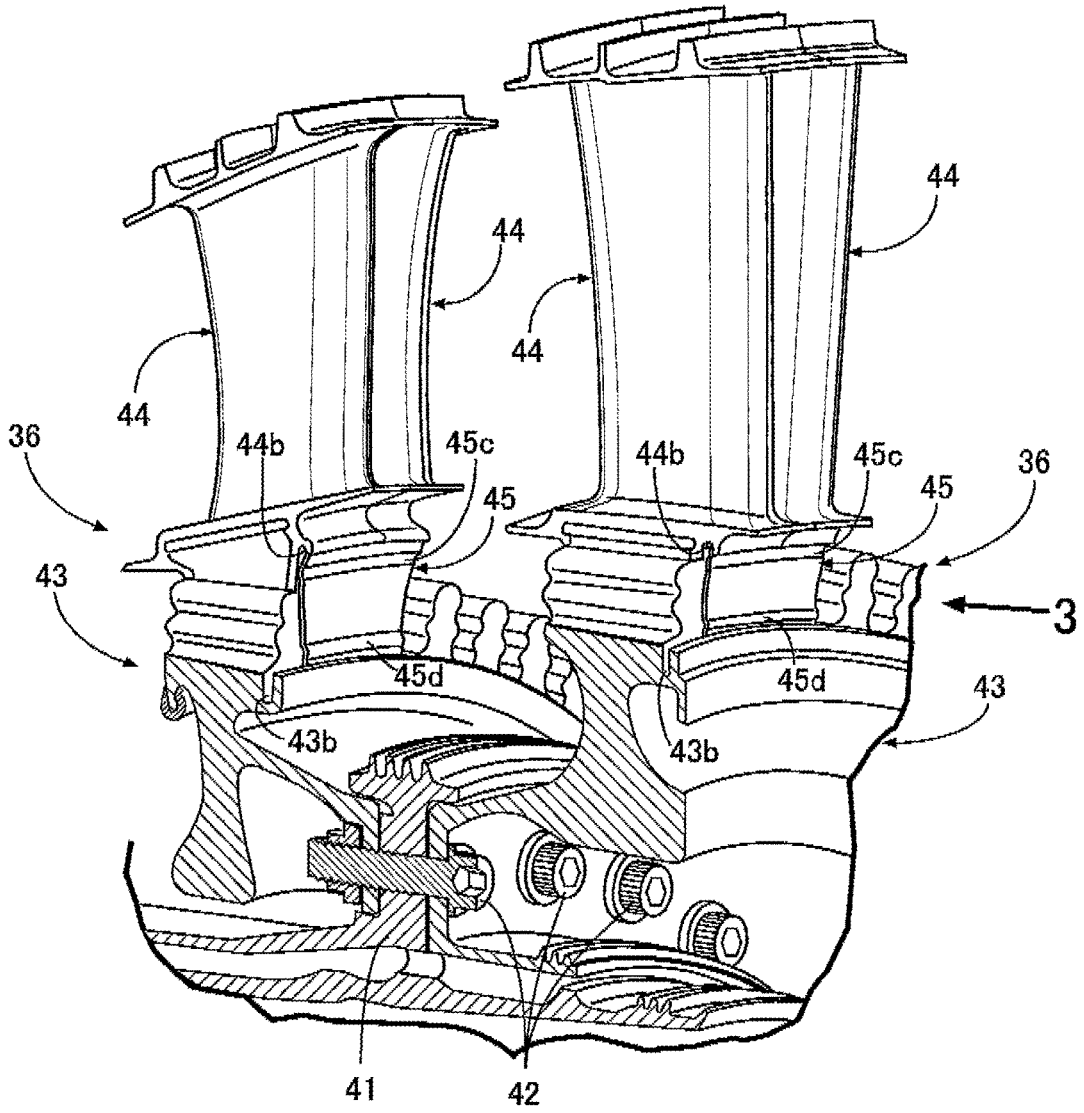
FIG. 2 is a view showing a main part of a low-pressure turbine in a direction indicated with an arrow 2 in FIG. 1.

As shown in FIG. 2, the low-pressure turbine 32 of the embodiment includes the two low-pressure turbine wheels 36. However, the two low-pressure turbine wheels 36 have substantially the same structure. For this reason, descriptions will be hereinbelow provided for one low-pressure turbine wheel 36.

Figure 3:
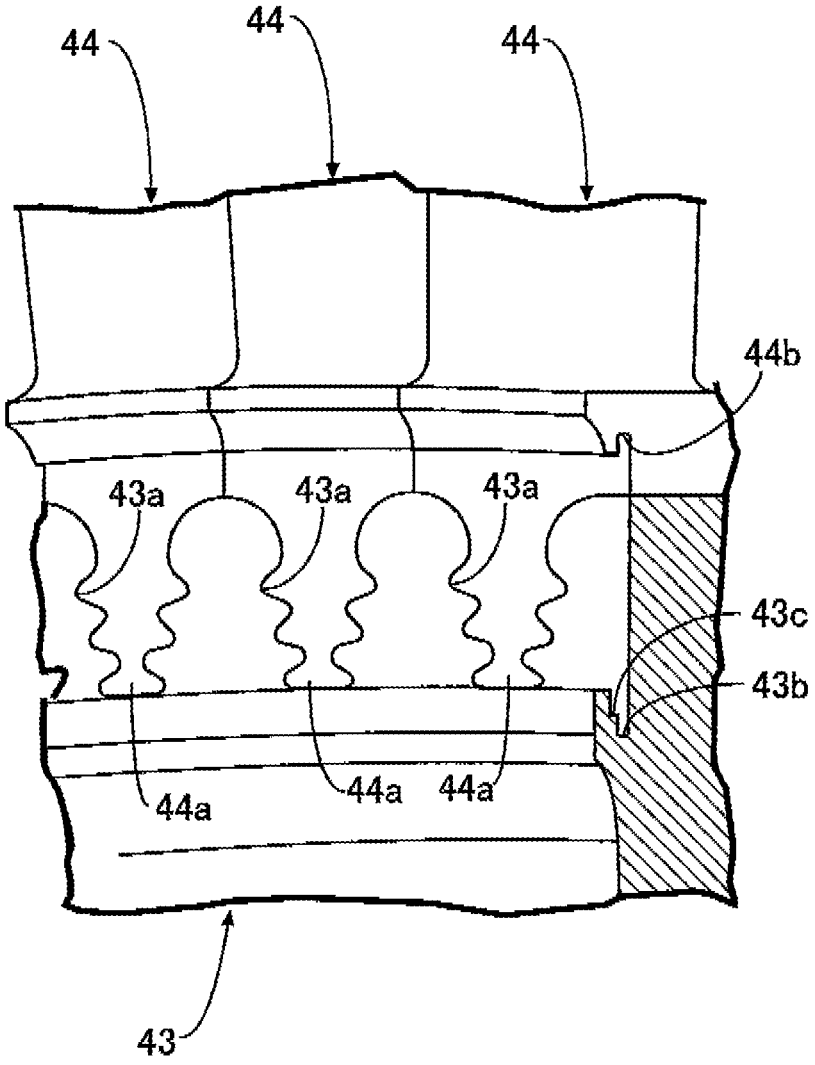
FIG. 3 is a view of a part shown in a direction indicated with an arrow 3 in FIG. 2, corresponding to a condition in which a seal plate is removed from the part.

As shown in FIGS. 2 and 3, the low-pressure turbine wheel 36 includes: an annular turbine disk 43 fixed, with bolts 42, to an outer periphery of a boss 41 which is spline-connected to an outer periphery of the low-pressure system shaft 15; and multiple turbine blades 44 radially fixed to an outer periphery of the turbine disk 43. In order to withstand centrifugal force, the turbine blades 44 are supported by the turbine disk 43 with the assistance of a so-called Christmas-tree structure in which protrusions 44*a* projectingly provided to base end portions of the turbine blades 44 are respectively fitted into groove portions 43*a* formed in the outer periphery of the turbine disk 43 from the rear in the axial direction. Seal plates 45 are attached to a rear surface of the turbine disk 43 in a way that one seal plate 45 is provided to each two turbine blades 44 for the purpose of: preventing the protrusions 44*a* of the turbine blades 44 coming out of the respective groove portions 43*a* in the turbine disk 43 in the axial direction: and sealing gaps between the protrusions 44*a* and the groove portions 43*a* which are fitted to each other.

To this end, an inner annular groove 43*b* opened outward in the radial direction is formed in a radially inner portion of the rear surface of the turbine disk 43, while outer annular grooves 44*b* opened inward in the radial direction are formed in rear surfaces of portions of the turbine blades 44 which face the protrusions 44*a*. The outer annular grooves 44*b* have a constant width in a front-rear direction. On the other hand, a step portion 43*c* is formed at a radially intermediate position of the inner annular groove 43*b*. The inner annular groove 43*b* is greater in front-rear width at its outer portion beyond the step portion 43*c* in the radial direction.

Figure 4:
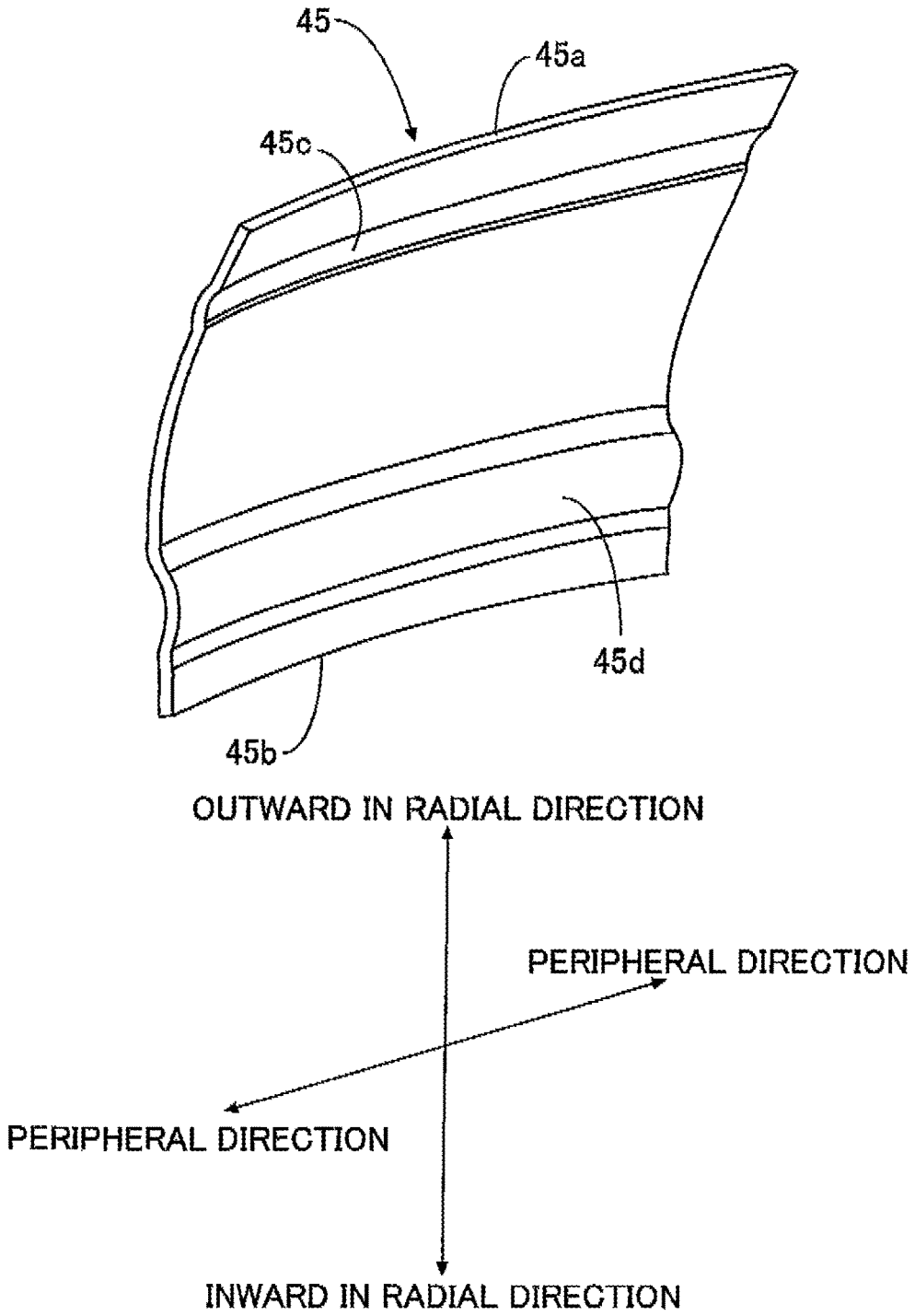
FIG. 4 is a perspective view of the seal plate.

As shown in FIG. 4, each seal plate 45 is formed from an elastic metal plate having a substantially rectangular shape. A radially intermediate portion of the seal plate 45 is curved and projects further toward rear end surfaces of the turbine blades 44 and the turbine disk 43 than opposite radial end portions of the seal plate 45. A groove-shaped assembly recessed portion 45*c* recessed in the axial direction toward the rear end surfaces of the turbine blades 44 and the turbine disk 43 is formed in a peripheral direction along a radially outer end portion 45*a* of the seal plate 45. In addition, a ridge-shaped disassembly protrusion 45*d* projecting in the axial direction in a way to get away from the rear end surfaces of the turbine blades 44 and the turbine disk 43 is formed in the peripheral direction along a radially inner end portion 45*b*.

Next, descriptions will be provided for an operation of the embodiment of the present invention including the foregoing configuration.

One seal plate 45 is attached to each two turbine blades 44 in order that with the protrusions 44*a* of the turbine blades 44 fitted into the groove portions 43*a* in the turbine disk 43 in the axial direction, the gaps between the groove portions 43*a* and the turbine blades 44 can be sealed with the seal plate 45.

Figure 5A:
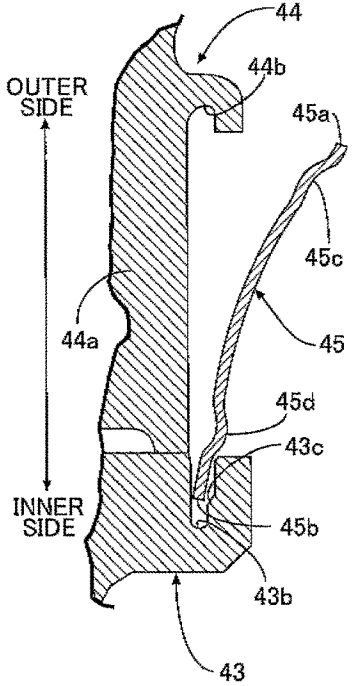
FIGS. 5A to 5C are views for explaining a procedure for attaching the seal plate.
Figure 5B:
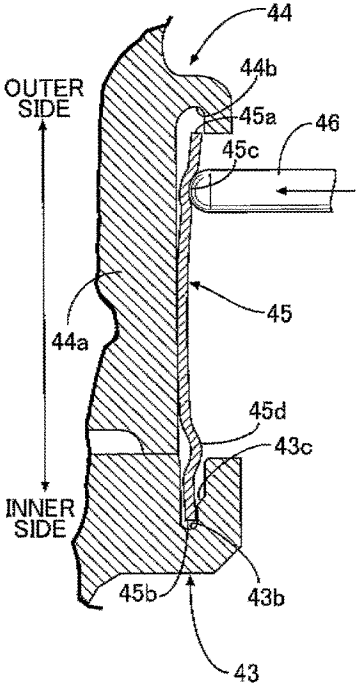
Figure 5C:
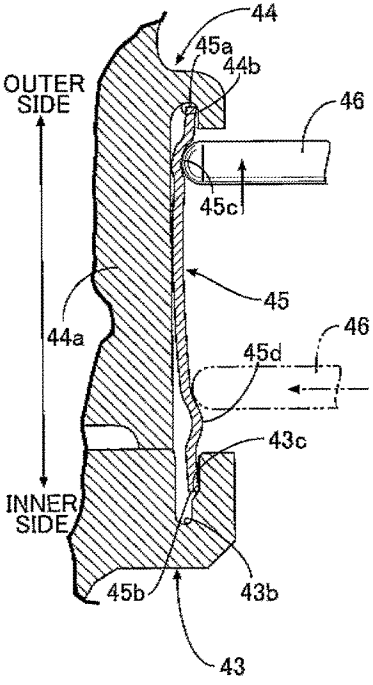

FIGS. 5A to 5C show a procedure for attaching the seal plate 45. As shown in FIG. 5A, first of all, the radially inner end portion 45*b* of the seal plate 45 is inserted into the inner annular groove 43*b* in the turbine disk 43 with a projecting-portion side of the arc-shaped curving seal plate 45 faced to the rear end surfaces of the turbine blades 44 and the turbine disk 43.

Subsequently, as shown in FIG. SB, with the radially inner end portion 45*b* of the seal plate 45 held in contact with a groove bottom of the inner annular groove 43*b*, the assembly recessed portion 45*c* of the seal plate 45 is pressed with a tip end of a tool 46, and is thereby elastically deformed in a way that its curvature diminishes. By this the radially outer end portion 45*a* is faced to openings of the outer annular grooves 44*b* of the turbine blades 44.

Thereafter, as shown in FIG. 5C, when the radially outer end portion 45*a* of the seal plate 45 is brought into contact with a groove bottom of the outer annular grooves 44*b* of the turbine blades 44 by moving the tip end of the tool 46 outward in the radial direction, the seal plate 45 starts to return to its original curving shape due to its own elasticity. Thereby, the radially inner end portion 45*b* comes into engagement with the step portion 43*c* in the inner annular groove 43*b* of the turbine disk 43, and is accordingly prevented from moving inward in the radial direction. Thus, the seal plate 45 is fixed onto the rear end surfaces of the turbine blades 44 and the turbine disk 43.

Detachment of the seal plate 45 is achieved as follows. As indicated with dot-dash lines in FIG. 5C, the radially inner end portion 45*b* is released from its engagement with the step portion 43*c* in the inner annular groove 43*b* of the turbine disk 43 by pressing a portion of the seal plate 45 outward of the disassembly protrusion 45*d* in the radial direction with the tip end of the tool 46. Thereafter, the radially inner end portion 45*b* of the seal plate 45 is brought into contact with the groove bottom of the inner annular groove 43*b* of the turbine disk 43 by moving the tip end of the tool 46 inward in the radial direction. Thereby, the radially outer end portion 45*a* of the seal plate 45 comes out of the outer annular grooves 44*b* of the turbine blades 44. Thus, the seal plate 45 is detached from the turbine blades 44 and the turbine disk 43.

Meanwhile, if the seal plate 45 formed from the elastic plate member would be excessively deformed when as shown in FIG. 5B, the assembly recessed portion 45*c* is pressed with the tool 46 for the purpose of attaching the seal plate 45, the seal plate 45 would lose its elasticity due to its plastic deformation. As a result, while in the attached state shown in FIG. 5C, the radially inner end portion 45*b* may come out of engagement with the step portion 43*c* in the inner annular groove 43*b* of the turbine disk 43 so that the seal plate 45 may accordingly come off.

In contrast, according to the embodiment, when the assembly recessed portion 45*c* is pressed with the tool 46, a tip end of the assembly recessed portion 45*c* comes into contact with the rear end surface of each turbine blade 44 or the turbine disk 43, and the seal plate 45 is accordingly blocked from being excessively deformed (see FIG. 5B). For this reason, the seal plate 45 is prevented from being plastically deformed, and is precluded from coming off the turbine blades 44 and the turbine disk 43.

Furthermore, the assembly recessed portion 45*c* is formed from the groove extending in the peripheral direction of the seal plate 45, and the section of the assembly recessed portion 45*c* is gently arc-shaped (see FIG. 4). The gently arc-shaped section not only makes it easier to control a thickness of the assembly recessed portion 45*c* and secures strength of the assembly recessed portion 45*c* more reliably while the seal plate 45 is being manufactured than in a case where the assembly recessed portion 45*c* is formed from a protrusion whose section is, for example, quadrangular box-shape. But also, the gently arc-shaped section makes stress less likely to concentrate on the assembly recessed portion 45*c* when the assembly recessed portion 45*e* is pressed for the purpose of fitting the seal plate 45 into the outer annular grooves 44*b* of the turbine blades 44, and makes the assembly recessed portion 45*c* and its vicinity come into contact with the rear end surface of each turbine blade 44 or the turbine disk 43 with a wider area. This makes it possible to prevent the plastic deformation of the seal plate 45 more securely.

The foregoing descriptions have been provided for the embodiment of the present invention. Various design changes, however, can be made to the present invention within the scope not departing from the gist of the present invention.

For example, although one seal plate 45 is attached to each two turbine blades 44 in the embodiment, the present invention is not limited to this.

What is claimed is:

1. A turbine wheel comprising:

a turbine disk including a plurality of groove portions which are formed in its outer periphery;

a plurality of turbine blades respectively including protrusions which are formed on their base ends, and fixed to the turbine disk by fitting the protrusions into the groove portions in an axial direction;

outer annular grooves each formed in one axial end surface of a corresponding turbine blade, and each opened inward in a radial direction;

an inner annular groove formed in one axial end surface of the turbine disk, and opened outward in the radial direction; and seal plates for sealing gaps between the groove portions and the protrusions, each seal plate being fixed to the one axial end surface of a respective one of the plurality of turbine blades and the one axial end surface of the turbine disk with a radially outer end portion of the seal plate in contact with a groove bottom of the outer annular groove of the respective one of the plurality of turbine blades, and with a radially inner end portion of the seal plate in engagement with a step portion in the inner annular groove, wherein each seal plate is formed from an elastic plate member whose radially intermediate portion is curved projecting in a first direction toward the one axial end surface of the respective one of the plurality of turbine blades and the one axial end surface of the turbine disk, and each seal plate includes an assembly recessed portion, which is recessed in a direction getting closer to the one axial end surface of the respective one of the plurality of turbine blades and the one axial end surface of the turbine disk, in a position near a radially outer end of the seal plate, the assembly recessed portion being adapted to receive a tip end of a tool and being formed in a part of the seal plate that is continuously curved with the radially intermediate portion to project in the first direction, and a disassembly protrusion, which projects in a direction getting away from the one axial end surface of the respective one of the plurality of turbine blades and the one axial end surface of the turbine disk, in a position near a radially inner end of the seal plate, wherein each seal plate is adapted to elastically deform to flatten a curve of the radially intermediate portion when the tool, with the tip end received in the assembly recessed portion, is moved in the first direction.

2. The turbine wheel according to claim 1, wherein the assembly recessed portion is formed from a groove extending in a peripheral direction of the seal plate, and a section of the assembly recessed portion is arcuate.

3. The turbine wheel according to claim 1, wherein the assembly recessed portion is formed from a first groove in the seal plate, the first groove defining a first recess in a first side of the seal plate, the first side of the seal plate facing in a second direction away from the one axial end surface of the respective one of the plurality of turbine blades and the one axial end surface of the turbine disk, and a first projection on a second side of the seal plate, the second side of the seal plate facing in the first direction.

4. The turbine wheel according to claim 3, wherein the disassembly protrusion is formed from a second groove in the seal plate, the second groove defining a first projection in the first side of the seal plate, and a second recess on the second side of the seal plate.

5. The turbine wheel according to claim 1, wherein each seal plate is adapted to elastically deform to flatten the curve of the radially intermediate portion so that the radially inner end portion of the seal plate disengages from the step portion in the inner annular groove, when the tool is pressed against the disassembly protrusion in the first direction.

6. The turbine wheel according to claim 5, wherein the assembly recessed portion is formed from a first groove in the seal plate, the first groove defining a first recess in a first side of the seal plate, the first side of the seal plate facing in a second direction away from the one axial end surface of the respective one of the plurality of turbine blades and the one axial end surface of the turbine disk, and a first projection on a second side of the seal plate, the second side of the seal plate facing in the first direction.

7. The turbine wheel according to claim 6, wherein the disassembly protrusion is formed from a second groove in the seal plate, the second groove defining a first projection in the first side of the seal plate, and a second recess on the second side of the seal plate.

8. The turbine wheel according to claim 5, wherein each seal plate is adapted to elastically deform to flatten the curve of the radially intermediate portion to allow the radially outer end portion of the seal plate, during assembly, to be received in the outer annular groove of the respective one of the plurality of turbine blades, when the radially inner end portion of the seal plate is in engagement with a groove bottom of the inner annular groove and the tool received in the assembly recessed portion is moved in the first direction.

9. The turbine wheel according to claim 8, wherein the assembly recessed portion is formed from a first groove in the seal plate, the first groove defining a first recess in a first side of the seal plate, the first side of the seal plate facing in a second direction away from the one axial end surface of the respective one of the plurality of turbine blades and the one axial end surface of the turbine disk, and a first projection on a second side of the seal plate, the second side of the seal plate facing in the first direction.

10. The turbine wheel according to claim 9, wherein the disassembly protrusion is formed from a second groove in the seal plate, the second groove defining a first projection in the first side of the seal plate, and a second recess on the second side of the seal plate.

11. The turbine wheel according to claim 1, wherein each seal plate is adapted to elastically deform to flatten the curve of the radially intermediate portion to allow the radially outer end portion of the seal plate, during assembly, to be received in the outer annular groove of the respective one of the plurality of turbine blades, when the radially inner end portion of the seal plate is in engagement with a groove bottom of the inner annular groove and the tool received in the assembly recessed portion is moved in the first direction.

12. The turbine wheel according to claim 11, wherein the assembly recessed portion is formed from a first groove in the seal plate, the first groove defining a first recess in a first side of the seal plate, the first side of the seal plate facing in a second direction away from the one axial end surface of the respective one of the plurality of turbine blades and the one axial end surface of the turbine disk, and a first projection on a second side of the seal plate, the second side of the seal plate facing in the first direction.

13. The turbine wheel according to claim 12, wherein the disassembly protrusion is formed from a second groove in the seal plate, the second groove defining a first projection in the first side of the seal plate, and a second recess on the second side of the seal plate.

* * * * *